US009660395B2

(12) United States Patent
Yeom

(10) Patent No.: US 9,660,395 B2
(45) Date of Patent: May 23, 2017

(54) TERMINAL CONNECTION DEVICE HAVING LIGHT SOURCE MODULE

(71) Applicant: KOREA HITEK CO., LTD., Ansan-si, Gyeonggi-do (KR)

(72) Inventor: Kyu Hwa Yeom, Ansan-si (KR)

(73) Assignee: KOREA HITEK CO., LTD., Ansan-si, Gyeonggi-Do (KR)

( * ) Notice: Subject to any disclaimer, the term of this patent is extended or adjusted under 35 U.S.C. 154(b) by 0 days.

(21) Appl. No.: 14/904,468

(22) PCT Filed: Feb. 6, 2014

(86) PCT No.: PCT/KR2014/001016

§ 371 (c)(1),
(2) Date: Jan. 12, 2016

(87) PCT Pub. No.: WO2015/005557

PCT Pub. Date: Jan. 15, 2015

(65) Prior Publication Data

US 2016/0149355 A1 May 26, 2016

(30) Foreign Application Priority Data

Jul. 12, 2013 (KR) ..... 10-2013-0082173
Jul. 12, 2013 (KR) ..... 10-2013-0082177

(51) Int. Cl.
*H01R 13/717* (2006.01)
*H01R 13/46* (2006.01)
(Continued)

(52) U.S. Cl.
CPC ..... *H01R 13/7172* (2013.01); *H01R 13/46* (2013.01); *H01R 13/7175* (2013.01);
(Continued)

(58) Field of Classification Search
CPC ..... H01R 13/46; H01R 13/74; H01R 13/717; H01R 13/7172; H01R 13/7175;
(Continued)

(56) References Cited

U.S. PATENT DOCUMENTS 5,915,993 A * 6/1999 Belopolsky ..... H01R 13/717 439/490
6,257,906 B1 * 7/2001 Price ..... H01R 13/60 439/131
(Continued)

FOREIGN PATENT DOCUMENTS

JP 2005-138822 A 6/2005
JP 2006-301212 A 11/2006
(Continued)

OTHER PUBLICATIONS

International Search Report dated Jun. 25, 2014 issued in Application No. PCT/KR2014/001016 (with English Translation).

*Primary Examiner* — Tulsidas C Patel
*Assistant Examiner* — Travis Chambers
(74) *Attorney, Agent, or Firm* — KED & Associates, LLP

(57) ABSTRACT

Provided is a terminal connection device having a light source module that is installed at a front panel terminal for a vehicle and is capable of emitting light around the terminal, the terminal connection device including: a housing having an inner space and an opening part; a terminal part having a printed circuit board located at an inner side of the housing, and a terminal mounted to the printed circuit board; a housing cover sealing the opening part of the housing and protecting the terminal part; an LED light source mounted to the printed circuit board and adopted to radiate light to the housing cover; and a border lighting part located at the housing cover and arranged to face an edge of one end of the terminal, the border light part protruding from one surface of the housing cover.

20 Claims, 14 Drawing Sheets

(51) Int. Cl.
*H01R 13/74* (2006.01)
*H01R 27/02* (2006.01)
*H01R 24/62* (2011.01)

(52) U.S. Cl.
CPC ..... *H01R 13/74* (2013.01); *H01R 27/02* (2013.01); *H01R 24/62* (2013.01); *H01R 2201/26* (2013.01)

(58) Field of Classification Search
CPC .... H01R 24/62; H01R 27/02; H01R 2201/26; H01R 13/641; H01H 9/161
USPC ..... 439/488, 490, 489; 340/656
See application file for complete search history.

(56) References Cited

U.S. PATENT DOCUMENTS 6,336,825 B1 * 1/2002 Seefried ..... G02B 6/4204 439/488
7,654,858 B2 * 2/2010 Geiger ..... H01R 13/641 439/490
8,206,019 B2 * 6/2012 Chen ..... G02B 6/0008 362/581
8,303,333 B2 * 11/2012 Lee ..... H01R 13/7175 439/488
8,519,864 B2 * 8/2013 Yajima ..... G02B 6/0008 340/815.65
8,574,001 B2 * 11/2013 Lee ..... H01R 13/7172 200/313
8,864,515 B2 * 10/2014 Oh ..... H01R 13/5213 439/490
9,160,118 B2 * 10/2015 Tuchrelo ..... H01R 13/7175
2007/0059975 A1 * 3/2007 Walsh ..... H01R 13/6691 439/490
2009/0305549 A1 * 12/2009 Liu ..... H01R 13/7175 439/490

FOREIGN PATENT DOCUMENTS

KR 20-0438600 Y1 2/2008
KR 10-2009-0120877 A 11/2009

* cited by examiner

TERMINAL CONNECTION DEVICE HAVING LIGHT SOURCE MODULE

CROSS-REFERENCE TO RELATED PATENT APPLICATIONS

This application is a U.S. National Stage Application under 35 U.S.C. §371 of PCT Application No. PCT/KR2014/001016, filed Feb. 6, 2014, which claims priority to Korean Patent Application Nos. 10-2013-0082173 and 10-2013-0082177, both filed Jul. 12, 2013, whose entire disclosures are hereby incorporated by reference.

TECHNICAL FIELD

Embodiments of the present invention relate generally to terminal connection devices, more particularly, to a terminal connection device having a light source module that is installed in a front panel for a vehicle or the like to radiate light around a terminal, the terminal connection device being mounted to the front panel for a vehicle, thereby electrically connecting an external apparatus to an electric apparatus system for a vehicle.

BACKGROUND ART

Car technologies are developing from day to day at a very fast rate. Cars have been developed as environmentally friendly intelligent cars that can stably, conveniently move at rapid speeds. In addition to the development of car technologies, electronic equipment and communication technologies have been also significantly developed. In this atmosphere, an electronic system for a vehicle has been promptly evolved according to the needs of times for enabling a convenient connection to the internet anywhere or anytime and information interchange with other persons via a communication network.

The electronic system for a vehicle is basically configured to control or support elements related to driving or safety of the vehicle, and is additionally required to carry out various functions of enabling communications with an external apparatus (a high-performance portable terminal or the like) of a driver or a passenger of the vehicle, of receiving an audio input of the external apparatus and outputting it via a vehicle speaker, of supplying energy stored in a vehicle battery and the like to the external apparatus, and the like.

According to these needs, various terminal connection devices have been recently installed at a front panel of a driver's seat of the vehicle. Most of the terminal connection devices are arranged such that an audio input terminal (AUX) or a USB (Universal Serial Bus) terminal having a simple structure is inserted into the front panel. Through the front panel, a driver operates a button on the front panel during driving or carries out desired working, such as operations of various electronic apparatuses, charging, and the like, using a terminal.

Meanwhile, it is preferable that the terminal connection device mounted to the vehicle be installed so that the driver can safely use it during driving in the daytime or at night. However, the terminal connection device installed at the front panel has not been yet configured so that the driver can simply identify and use a desired terminal during driving in the daytime or at night. Accordingly, the terminal connection device may be a potential risk factor that causes a safety accident.

As one example, when the driver turns away his or her eyes from a front portion of the vehicle to other places in order to find an audio input terminal (AUX) or a USB terminal for connection of the external apparatus during driving, the driver cannot promptly respond to emergency circumstances, such as the sudden appearance of an object from the front of the vehicle, or the like, thereby causing an accident.

In addition, according to consumers' diversified tastes, many functions have been required to be provided with the front panel of the vehicle. For example, demands for a structure in which a driver can accurately find a desired terminal without directly looking an operating button or the terminal, a structure or function in which a driver can accurately find a button or terminal even at night, or a structure in which a terminal connection device can be used as interior decoration inside a vehicle have been increasing.

As such, despite the fact that a terminal connection device that is suitable for safety of a vehicle has been recently required, the results of research and development concerning a connection device of an external terminal related thereto are not yet sufficient.

DISCLOSURE OF INVENTION

Technical Problem

The present invention has been made to solve the above problems, an object of the present invention provides a terminal connection device that can provide aesthetic sensibility by enabling light to be supplied to the terminal area of a front panel of a vehicle and can allow a driver to easily recognize a desired terminal during driving at night, the terminal connection device being capable of minimizing the occurrence of a shadow area and being capable of concentrating light, thereby preventing the light from coming to undesired other areas.

Another object of the embodiments of the present invention provides an external terminal connection device that can allow a driver to easily identify and use a terminal during driving at night and can be used as interior decoration of a vehicle.

A further object of the embodiments of the present invention provides an external terminal connection device that can effectively radiate lighting to a plurality of terminals using a small number of light sources.

Solution to Problem

In order to solve the technical problems, according to an aspect of the present invention, there is provided a terminal connection device, including: a housing having an inner space and an opening part; a terminal part having a printed circuit board located at an inner side of the housing, and a terminal mounted to the printed circuit board; a housing cover sealing the opening part of the housing and protecting the terminal part; an LED light source mounted to the printed circuit board and adopted to radiate light to the housing cover; and a border lighting part located at the housing cover and arranged to face an edge of one end of the terminal, the border light part protruding from one surface of the housing cover.

In one embodiment, a protruding height of the border light part may range from 0 or more to 3 mm or less.

In one embodiment, the housing cover may include a light guide part that receives light from the LED light source and changes a light traveling direction at least two times, thereby transmitting the light to a front surface of the housing cover, the light guide part including a guide prism.

According to another aspect of the present invention, there is provided a terminal connection device, including: a housing; a terminal part having a printed circuit board located at an inner side of the housing and a terminal mounted to the printed circuit board; a housing cover sealing an opening part of the housing and protecting the terminal part; and an LED light source mounted to the printed circuit board and adopted to radiate light to the housing cover, wherein the housing cover comprises a light guide part that receives light from the LED light source and changes a light traveling direction at least two times, thereby transmitting the light to a front surface of the housing cover, the light guide part having an integrated structure.

In one embodiment, the light guide part may include a guide prism.

In one embodiment, the terminal connection device may further include a border lighting part located at the housing cover and arranged to face an edge of one end of the terminal, the border light part protruding from one surface of the housing cover at a specific height.

According to a further aspect of the present invention, there is provided a terminal connection device, including: a printed circuit board; a plurality of terminals mounted to the printed circuit board; an LED light source mounted to the printed circuit board; and a housing cover adopted to guide light of the LED light source by dividing the light into the light of a first area and the light of a second area and to radiate the light to a front surface for exposing the plurality of terminals by refracting the light at least two times.

In one embodiment, the housing cover may include a guide prism that primarily refracts light incident from the outside and secondarily reflects the light collided with an inner wall of the housing cover at least one time, thereby radiating the light to a front surface of the housing cover.

In one embodiment, the LED light source may include a single first LED light source arranged on a front surface of the printed circuit board, and a single second LED light source arranged on a rear surface of the printed circuit board, the first LED light source and the second LED light source radiating light from the front surface of the housing cover to an upper portion and a lower portion based on the plurality of terminals, respectively.

In one embodiment, mounting surfaces or light radiation directions of the first LED light source or the second LED light source may be roughly perpendicular to an extension direction of the front surface of the housing cover.

In one embodiment, the housing cover may include a light incoming part protruding toward the LED light source; and a barrier part protruding from the inner wall of the housing cover to the light incoming part.

In one embodiment, the plurality of terminals may include at least one audio input terminal, at least one USB (Universal Serial Bus) terminal, or a combination thereof.

Advantageous Effects of Invention

According to the present invention, in a terminal connection device, since a guide primes in a light guide part and a border lighting part protruding from a terminal border part are used, light from a separate light source can be effectively emitted to a front surface of a housing cover, and thus a driver can easily identify and use the terminal without looking the terminal with his or her eyes in the daytime or at night. In addition, the terminal connection device can exhibit an aesthetic impression effect as one of interior decoration.

In addition, according to the present invention, a terminal connection device can allow a driver to easily identify and use a connection terminal during driving in the daytime or at night thanks to lighting or a protruding structure of a border lighting part, and can be used as light interior decoration inside the vehicle.

Also, according to the present invention, a terminal connection device can enable a small number of light sources to effectively shine lighting to a plurality of terminals using a housing cover having a guide prism function.

BEST MODE FOR CARRYING OUT THE INVENTION

BEST MODE FOR CARRYING OUT THE INVENTION

Figure 1:
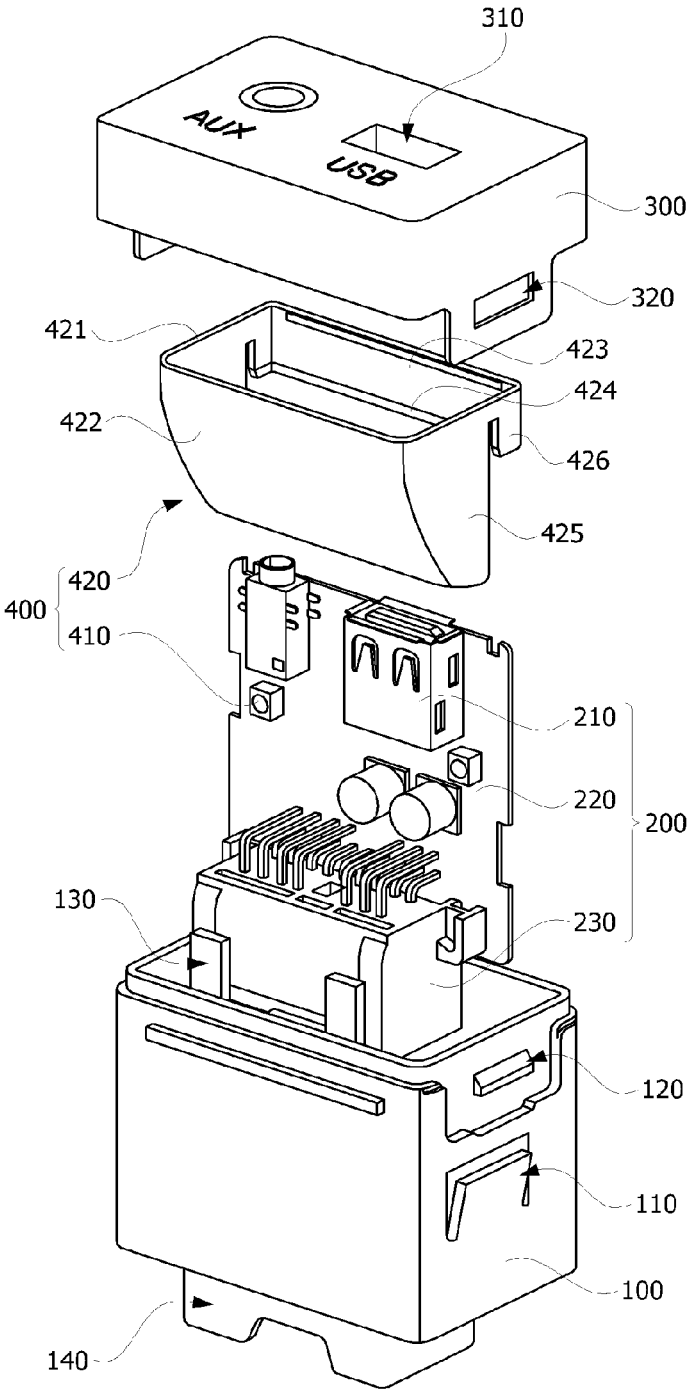
FIG. 1 is an exploded front perspective view of a terminal connection device having a light module according to an embodiment of the present invention.

Hereinafter, embodiments of the present invention that an ordinary person skilled in the art can easily implement will be described with reference to the accompanying drawings. However, in the description of the embodiments, when the known functions or functions are seemed to make unclear the subject matters of the present invention, they will be omitted from the descriptions of the invention. In order to clearly describe the present invention, parts unconnected to the description are omitted from the drawings, and the elements having the similar functions and operations of the drawings are given the same reference numerals throughout the specification.

Figure 2:
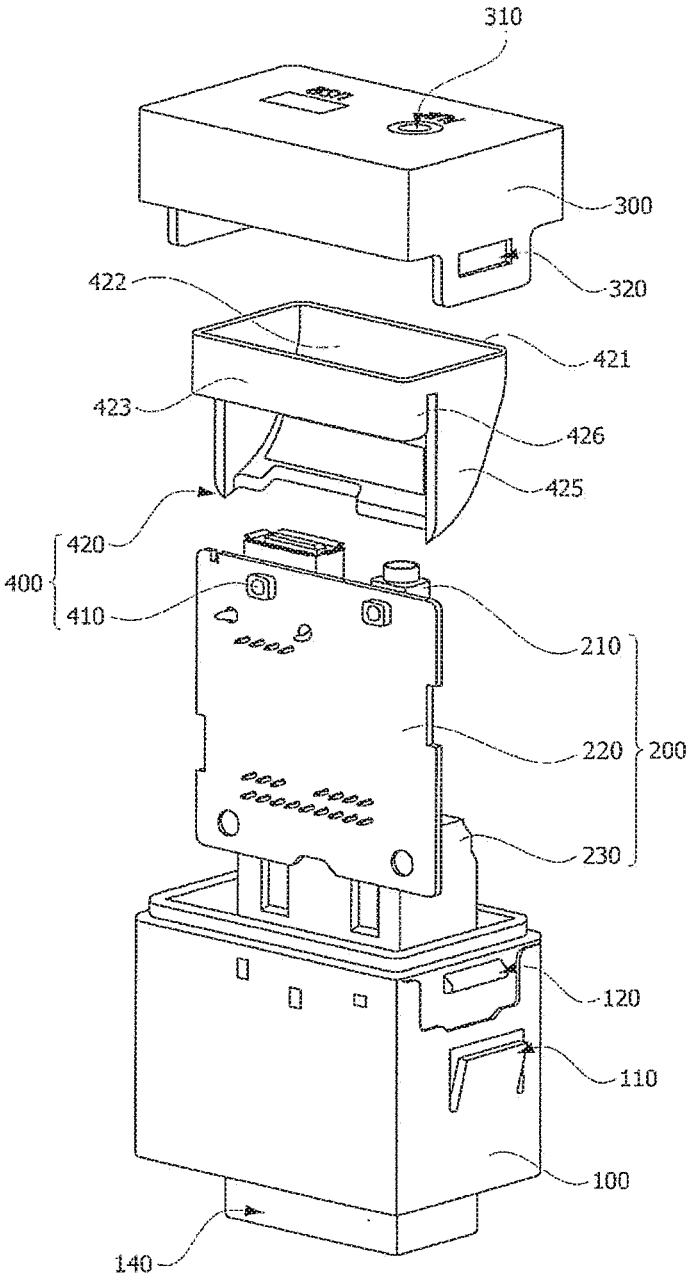
FIG. 2 is an exploded rear perspective view of the terminal connection device according to the embodiment of the present invention.
Figure 3:
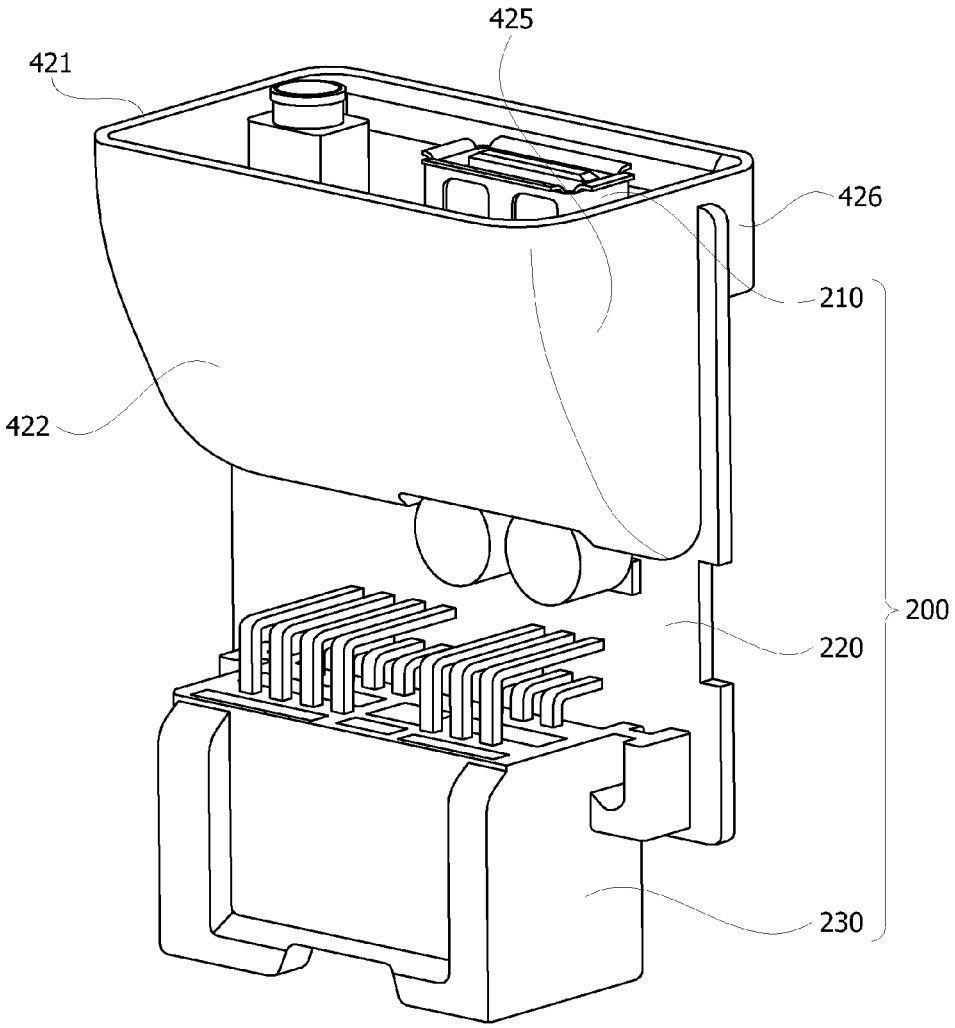
FIG. 3 is a view showing a terminal part, to which the light source is mounted, according to the embodiment of the present invention.
Figure 4:
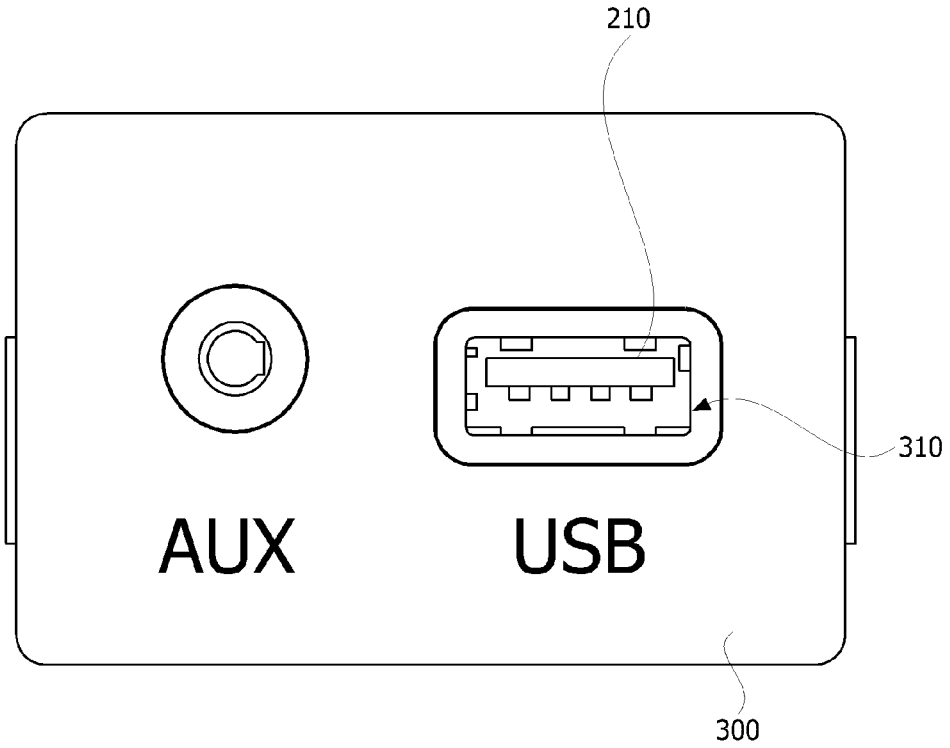
FIG. 4 is a plan view of the terminal connection device according to the embodiment of the present invention.
Figure 5:
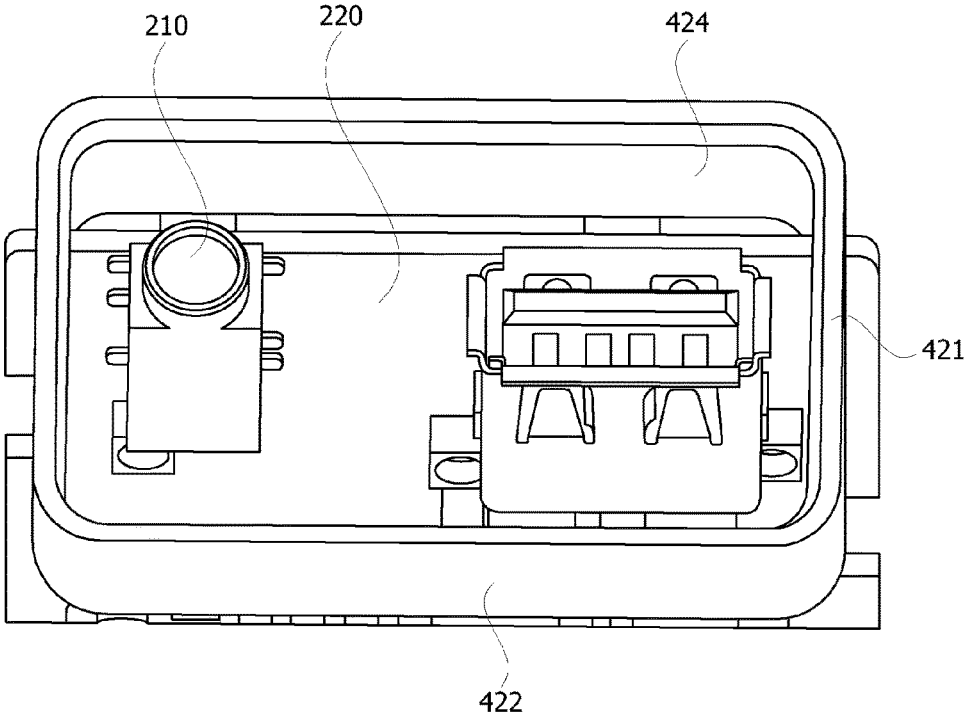
FIG. 5 is a plan view showing an example in which a housing cover is removed from the terminal connection device according to the embodiment.

FIG. 1 is an exploded front perspective view of a terminal connection device having a light module according to an embodiment of the present invention; FIG. 2 is an exploded rear perspective view of the terminal connection device according to the embodiment of the present invention; FIG. 3 is a view showing a terminal part, to which the light source is mounted, according to the embodiment of the present invention; FIG. 4 is a plan view of the terminal connection device according to the embodiment of the present invention; and FIG. 5 is a plan view showing an example in which a housing cover is removed from the terminal connection device according to the embodiment.

As illustrated in FIGS. 1 to 5, a terminal connection device having a light source module according to the present embodiment includes: a terminal housing 100 mounted to a front panel of a vehicle; a terminal part 200 located at an inner side of the terminal housing and including at least one terminal connected to an external apparatus; a housing cover 300 sealing the terminal housing to protect the terminal part; and a light source module 400 protecting the terminal included in the terminal part and radiating light to the housing cover.

The terminal housing 100 is produced in a rectangular container-like shape, wherein an upper portion of the terminal housing is open, and an inner portion of the terminal housing is hollow.

The terminal housing 100 includes one bottom surface and four sides. A panel fixing part 110 intended for fixing the terminal housing 100 to a mounting groove of the front panel of the vehicle is disposed at one side. A protruding member having a hook-like shape may be used as the fixing part. A covering fixing part 120 fixing the housing cover is disposed on two sides that face terminal housing. The cover fixing part may be referred to as a fixing hook part. Furthermore, a fixing member 130 fixing components such as the terminal part, a flat light source part, and the like, is disposed on an inner side of the terminal housing 100.

A housing through groove 140 is disposed on the bottom surface of the terminal housing 100. Power is supplied to each element arranged at the inner side of the terminal housing 100 via the housing through groove 140, and a printed circuit board (PCB) connector 230 of the terminal part is installed on an upper surface of the terminal housing 100 to be exposed to the outside, thereby enabling communications with each element. Therein, the PCB connector 230 is connected to a power supply device of the vehicle to receive power and is connected to a vehicle control part, thereby functioning to facilitate communications between the vehicle control part and a control part of the terminal connection device.

The terminal part 200 includes: at least one terminal 210 electrically connected to an external apparatus and exposed by passing through the housing cover 300; a printed circuit board 220 to which the terminal 210 is mounted; a PCB connector 230 intended for power supply in the vehicle and connection with the vehicle control part.

Examples of the terminal 210 may include a USB terminal, an audio terminal, or an audio input terminal (AUX). That is, in some embodiments of the present invention, the terminal is not limited to the examples, but may be variously modified. For example, the terminal may be other audio terminals other than AUX, or other communication terminals other than the USB terminal.

A board on which various circuit patterns are printed may be used as the printed circuit board 220. The printed circuit board 220 is mounted and fixed to the inner side of the terminal housing 100. The printed circuit board 220 is designed to supply power to the terminal 210 or to enable communications between the external apparatus connected to the terminal and the vehicle control part.

For example, various circuit elements may be mounted to the printed circuit board 220, and a determination part (not shown) adopted to recognize the external apparatus connected to the terminal or to determine whether or not the external apparatus is connected to the terminal may be also mounted to the printed circuit board. In addition, the printed circuit board 220 may include a communication control part (not shown) controlling communications between a communication network inside the vehicle and an external apparatus connected to the terminal. Moreover, the printed circuit board 220 may also include a signal conversion part (not shown) adopted to amplify or convert a signal. Since the configuration of such a printed circuit board has been already known, the detailed description thereof is omitted.

The PCB connector 230 may be provided on one surface of the printed circuit board 220 and may be connected to the power supply part of the vehicle and the vehicle control part. In this case, the PCB connector 230 applies power of the power supply part of the vehicle to the terminal 210 of the printed circuit board 220 so that the power can be supplied to the external apparatus connected to the terminal 210. In addition, the PCB connector 230 is connected to the vehicle control part, thereby functioning to enable communications between the external apparatus connected to the terminal and the vehicle control part.

The printed circuit board 220 is produced in a rectangular plate-like shape, and is inserted into and fixed to the inner side of the terminal housing 100. The terminal 210 is mounted in a predetermined area of the printed circuit board 220, which is located at an opening area of the terminal housing 100.

The housing cover 300 is produced in a cap-like shape, the housing cover being provided to cover an open upper portion of the terminal housing 100, namely, an opening area. The housing cover 300 is produced in a rectangular container-like shape, a lower portion of the housing cover being open. That is, housing cover 300 includes one upper surface and four cover sides. A terminal groove 310 to which the terminal 210 of the terminal part is exposed is formed on the upper surface of the housing cover. Furthermore, a fixed hook part 320 fixed to the cover fixing part 120 is provided on two cover sides. Thanks to this configuration, the housing cover 300 may come into close contact with the terminal housing 100 so that the housing cover and the terminal housing can be firmly fixed to each other.

The housing cover 300 may be made of a transparent material. Of course, the housing cover 300 may be also made of a light-impermeable material. Furthermore, a title of the terminal may be indicated around the terminal groove 310 of the housing cover 300. In this case, an area where the title is indicated has high translucency and advantageous visibility compared to other areas. That is, when the housing cover 300 is made of a light-impermeable material, only the corresponding area may be filled with a separate transparent material. In addition, when the housing cover 300 results from coating the surface of a transparent material with a light-impermeable material, the area where the title is indicated may not be coated with the light-impermeable material.

The light source module 400 is intended to provide a lighting effect by radiating light to the housing cover 300. The light source module 400 includes: at least one LED light source 410 mounted to the terminal part 200; and a light collection part 420 adopted to collect light emitted from the LED light source and to radiate the light to the housing cover 300.

The LED light source 410 is only one examples of the light source module. In the present embodiment, in addition to the LED light source, a light source similar to the LED light source, or other light sources that can replace the LED light source may be used. The LED light source 410 is mounted to the printed circuit board 220. The LED light source 410 may be mounted on a front surface or a rear surface of the printed circuit board 220.

For example, as illustrated in FIG. 1, when the LED light source 410 is mounted on the front surface of the printed circuit board 220 to which the terminal 210 is mounted, in order to increase the effect by a mounting area of the printed circuit board 220, the LED light source 410 may be mounted to a lower area of the terminal 210. In this case, a top view type LED is used as the LED light source to the front surface of the printed circuit board 220 so that light emitted from the LED light source 410 can be prevented from being blocked by the terminal 210.

In addition, as illustrated in FIG. 2, when the LED light source 410 is mounted on the rear surface of the printed circuit board 220 to which the terminal 210 is not mounted, the LED light source 410 may be disposed at a position corresponding to an upper area of the rear surface of the printed circuit board 220, the upper area corresponding to a rear surface of the area in which the terminal 210 is mounted. Thus, one surface of a connecting terminal of the LED light source 410 and the printed circuit board 220 may be protected by the terminal 210. Furthermore, when the LED light source is mounted on the rear surface of the printed circuit board, a side view type LED may be used as the LED light source. Thus, light emitted from the LED light source may be emitted in an upward direction, namely, in an extension direction of a major axis of the printed circuit board 220.

Meanwhile, the control part of the terminal connection device, which controls irradiation of the LED light source 410, may be installed as a separate constitution part in the terminal connection device, or may be implemented as a partial function portion of a main control part of the vehicle, or as a partial constitution portion of the main control part of the vehicle, the partial constitution portion being intended to perform this function. In addition, an LED light source that emits light having one color of RGB colors may be used as the LED light source 410. According to some embodiments, an LED light source that emit white light may be also used.

In the aforesaid description, as shown in FIG. 1, an LED mounted on a terminal mounting surface of the printed circuit board 220 may be referred to as a front LED light source, and as shown in FIG. 2, an LED mounted on a rear surface of the printed circuit board 220 may be referred to as a rear LED light source. Furthermore, the terminal connection device is configured such that the LED light source is disposed on the front surface and the rear surface of the printed circuit board 220 so that power can be supplied from the printed circuit board 220.

Meanwhile, since the LED light source 410 emits light in the form of a point light source, the light is concentrated in an area that faces the LED light source 410. This may cause a reduction of visibility because it makes it difficult to form uniform brightness on a front surface of the housing cover 300 to which the terminal 210 is exposed.

Thus, in the present embodiment, such a problem can be solved by the light collection part 420 that guides light emitting the LED light source 410, thereby dispersing the light in a direction of the housing cover 300.

That is, the light collection part 420 includes: an top portion 421 having a rectangular band-like shape and corresponding to an inner surface of the housing cover 300; a reflective surface 422 extending from one long side of the top portion to a downward direction, one side of which comes into contact with the printed circuit board 220; a rear extension surface 423 extending from another long side of the top portion 421 to a downward direction; a vertical surface 424 extending from the rear extension surface 423 to a vertical direction, one side of which comes into contact with the printed circuit board 220; two first side extending surfaces 425 that extend from opposite ends of the top portion to a lower portion along the reflective surface 424 and come into contact with the printed circuit board 220; and two second side extending surfaces 426 that are spaced apart from the first side extending surfaces by a predetermined distance and extend from the opposite ends of the top portion along the rear extension surface 423 and the vertical surface 424, thereby coming into contact with the printed circuit board 220.

The printed circuit board 220 is inserted into a separation space between the first side extending surfaces and the second side extending surfaces. By this structure, the reflective surface 422 and two first side extending surfaces 425 and an upper surface of the printed circuit board 220 make a space having a hollow inner portion (a front inner space). In addition, the rear extension surface 423, the vertical surface 424, the two second side extending surfaces 426, and a rear surface of the printed circuit board 220 make a space (a rear inner space) having a hollow inner portion. These inner spaces may prevent light of the LED light source 410 from being emitted to the outside, thereby enabling the light to be transmitted in the direction of the housing cover 300. Furthermore, the light collection part 420 may have a cup-like structure and may protect the LED light source 410, as well as the terminal 210, from an external shock.

The top portion 421 is produced in a rectangular band-like shape so that a size of the top portion is consistent with a size of an inner portion of the housing cover 300 within the margin of error (about 1 to 3%). The top portion 421 comes into close contact with the housing cover 300. Thus, the light of the LED light source 410 may be prevented from being exposed to the outside.

The reflective surface 422 includes a first surface vertically extending from the top portion 421 to a downward direction, and a second surface extending from the first surface to a direction of the printed circuit board 220. The second surface of the reflective surface comes into close contact with the printed circuit board 220. The second surface is produced in a curved surface form or an inclined surface form.

In the present embodiment, inner sides of the reflective surface 422 may be configured such that light is reflected. This light reflection structure may be implemented by making the inner sides of the reflective surface 422 smooth using surface grinding or the like, or by disposing a separate reflective sheet or coating material. When the light reflection structure is formed, in order to increase efficiency of the light reflection structure, the light reflection structure may be formed on the second surface of the reflective surface that faces the LED light source 410. This is because the second surface is installed so as to reflect the light of the LED light source to a front surface of the housing cover 300. In order to more effectively disperse light, a plurality of rugged parts (reflective patterns, reflective films, or the like) may be provided on the second surface.

The rear extension surface 423 horizontally extends from another major side of the top portion to the downward direction. The rear extension surface 423 extends to reach a position corresponding to a lower portion of an area in which the rear LED light source 410 is mounted. When a distance between one side of the printed circuit board 220 and the rear LED lights source 410 is 1, a length of the rear extension surface 423 may be 1.3 to 3.

The vertical surface 424 extends in a direction perpendicular to the extension direction of the rear extension surface 423. One surface of the vertical surface 424 may come into close contact with the printed circuit board 422.

The first side extending surfaces 425 extend from the top portion 421 to a downward direction and also extend downwards along the reflective surface 422 and the printed circuit board 220. Thus, the two first side extending surfaces 425, the reflective surface 422, and the printed circuit board 220 make a front inner space in which light can be concentrated. Moreover, since the first side extending surfaces 425 come in close contact with the printed circuit board 220, light may be prevented from being emitted to the outside. According to some embodiments, the first side extending surfaces 425 may have a roughly fan shape.

The second side extending surfaces 426 extend from the top portion 421 to the downward direction and also extend downwards along the rear extension surface 423 to reach the vertical surface 424. Furthermore, one side of the second side extending surfaces 426 comes into contact with the printed circuit board 220. Thus, the two second side extending surfaces 426, the rear extension surface 423, the vertical surface 424, and the printed circuit board 220 make a rear inner space in which light can be concentrated. The second side extending surfaces 436 also come in close contact with the printed circuit board 220 so that light may be prevented from being emitted to the outside. In the present embodiment, the second side extending surfaces 426 may be produced in a rectangular plate form.

As described above, the light collecting part 420 according to the present embodiment may form two inner spaces for the concentration of light depending on a position in which the LED light source 410 is mounted. Furthermore, since the light collecting part 420 surrounds the LED light source 410 and the terminal 210, it may protect the LED light source and the terminal against an external shock.

In addition, the first and second side extending surfaces 425, 426 may extend from the top portion 421. According to some embodiments, a separation space may be formed between the first and second side extending surfaces. In this case, the printed circuit board 220 may be inserted into the separation space. Therein, the printed circuit board may have a groove formed in a portion inserted into the separation space. This groove may prevent the printed circuit board 220 from being separated from the separation space and being moved after the printed circuit board has been inserted into the separation space of the light collecting part 420. Thanks to this configuration, the light collecting part 420 is stably fixed to the printed circuit board 220.

In the aforesaid description, it is shown that the LED light source 410 is mounted to each of the front surface (terminal mounting surface) and the rear surface of the printed circuit board 220. However, the present invention is not limited to such a configuration. The LED light source 410 may be only mounted on any one surface of the printed circuit board. In this case, a total size of the device can be reduced, and a shape of the light collecting part 420 can be appropriately modified. For example, the light collecting part 420 may include a separate light guide partition, a reflective member, a scattering leading pattern, or the like in order to uniformly transmit light collected from the LED light source installed on the front surface of the printed circuit board to the housing cover 300.

Figure 6:
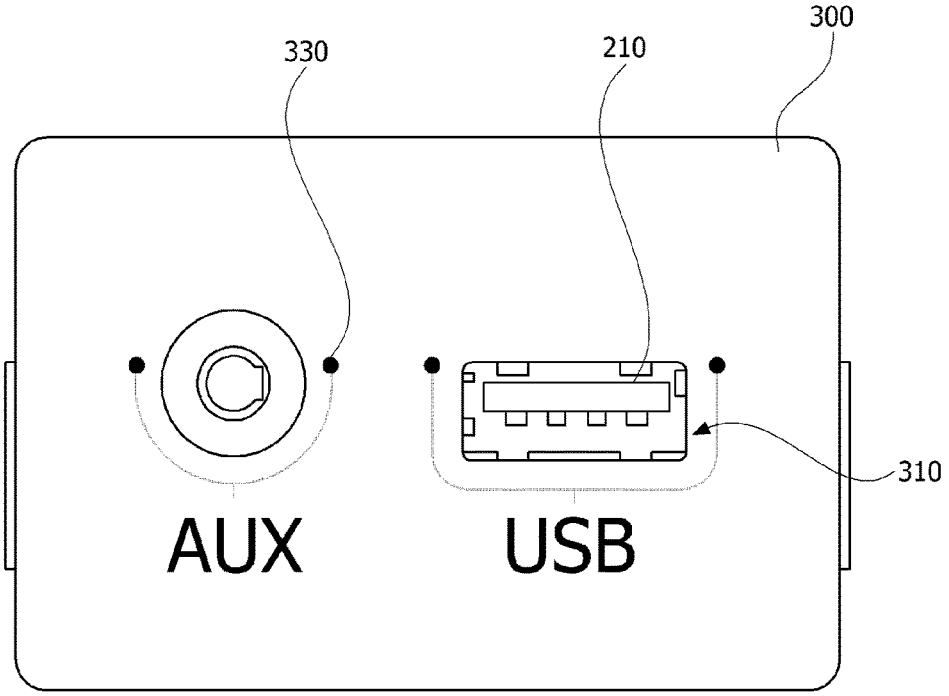
FIG. 6 is a plan view showing the terminal connection device for a vehicle according to a modified example of the embodiment.

FIG. 6 is a plan view of the terminal connection device according to a modified example of the embodiment.

As illustrated in FIG. 6, the terminal connection device according to the present embodiment is configured such that a border lighting part 330 is disposed on a circumference of the terminal groove 310 of a top surface of the housing cover 300 so that light collected by the light collecting part 420 located at a lower portion can be exposed to the outside via the border lighting part 330.

The border lighting part 330 may be configured in a similar manner to that of the area where the title is indicated.

According to the configuration, a driver can easily and accurately check a position of the terminal at night by using lighting emitted from the border lighting part 330.

Figure 7:
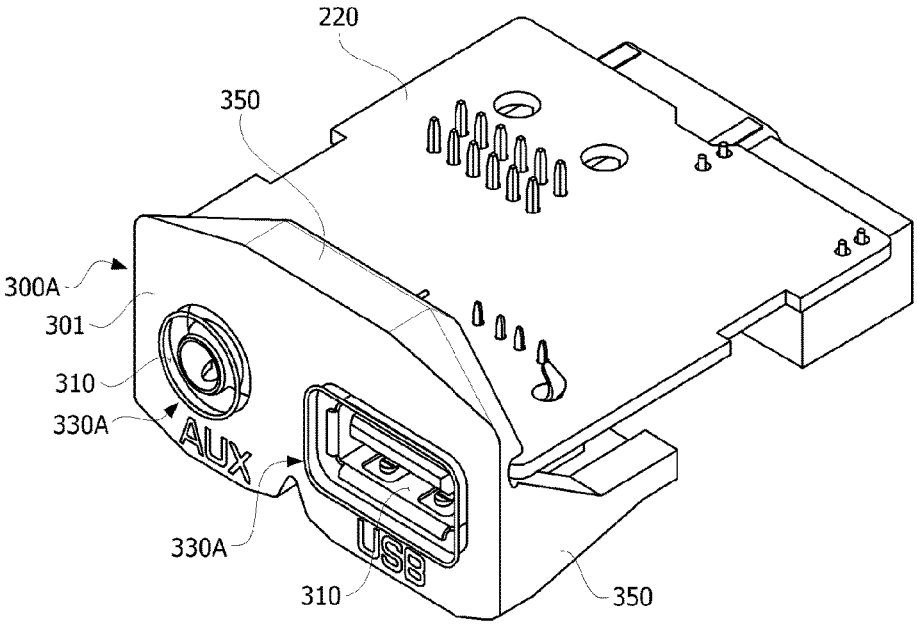
FIG. 7 is a perspective view of a terminal connection device according to another embodiment of the present invention.
Figure 8:
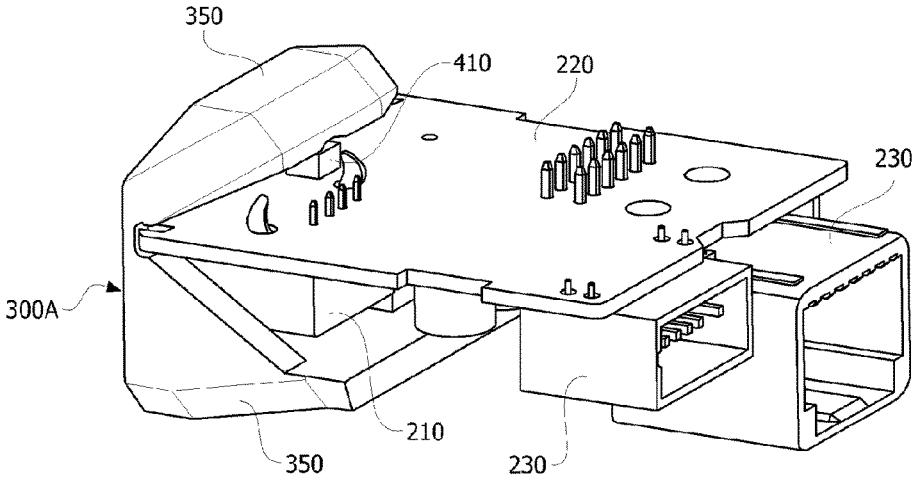
FIG. 8 is a perspective view showing an appearance of the terminal connection device when the terminal connection device of FIG. 7 is viewed from a rear side.
Figure 9:
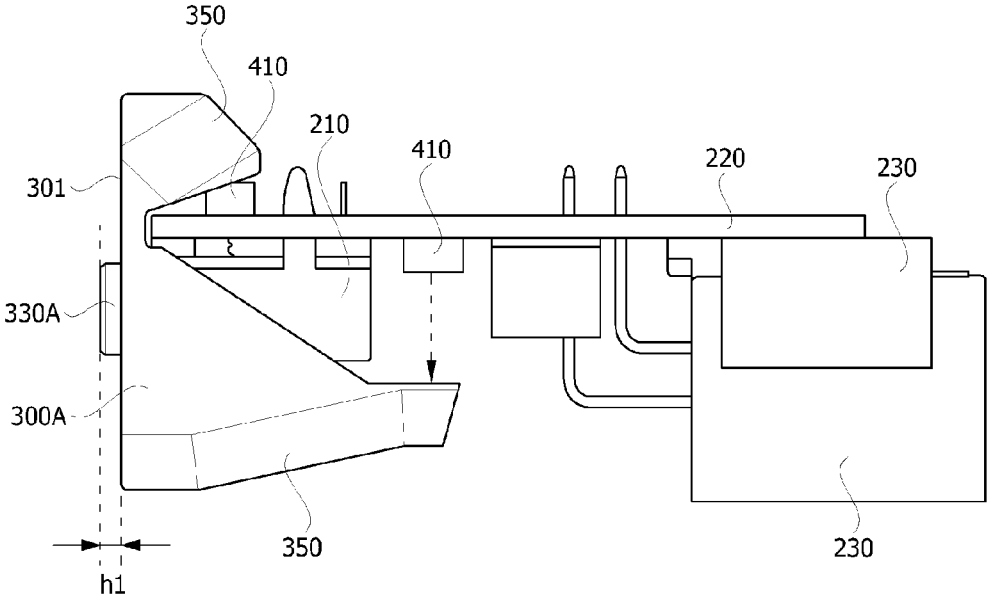
FIG. 9 is a right side view of the terminal connection device of FIG. 7.
Figure 10:
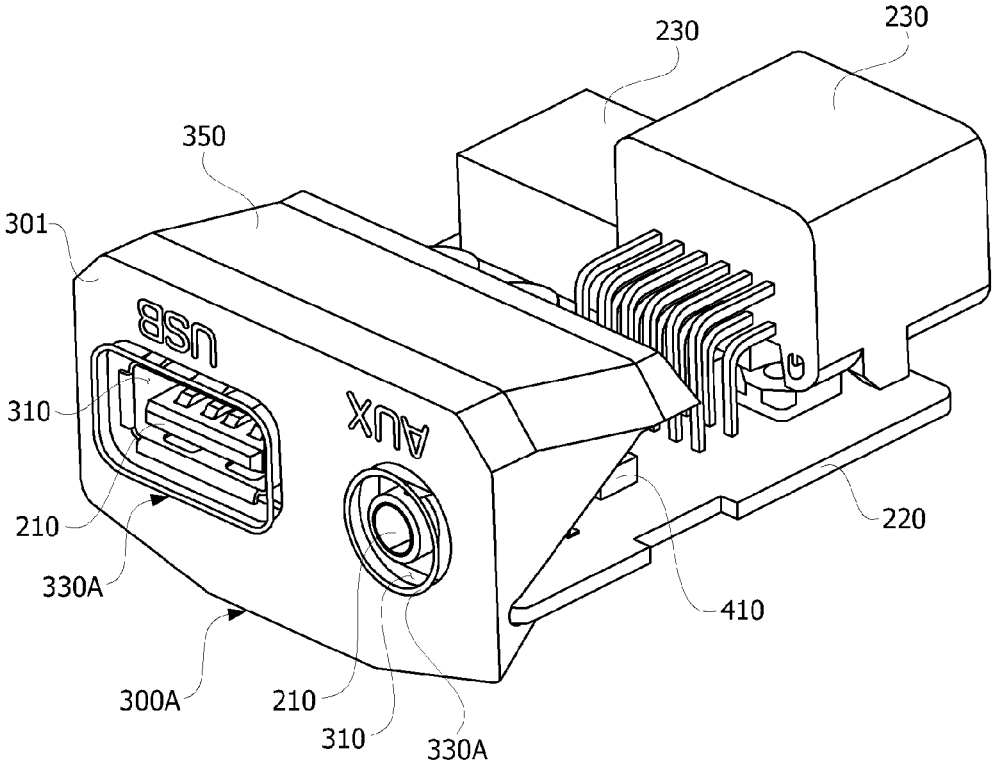
FIG. 10 is a perspective view showing an appearance of the terminal connection device resulting from inverting the terminal connection device of FIG. 7.
Figure 11:
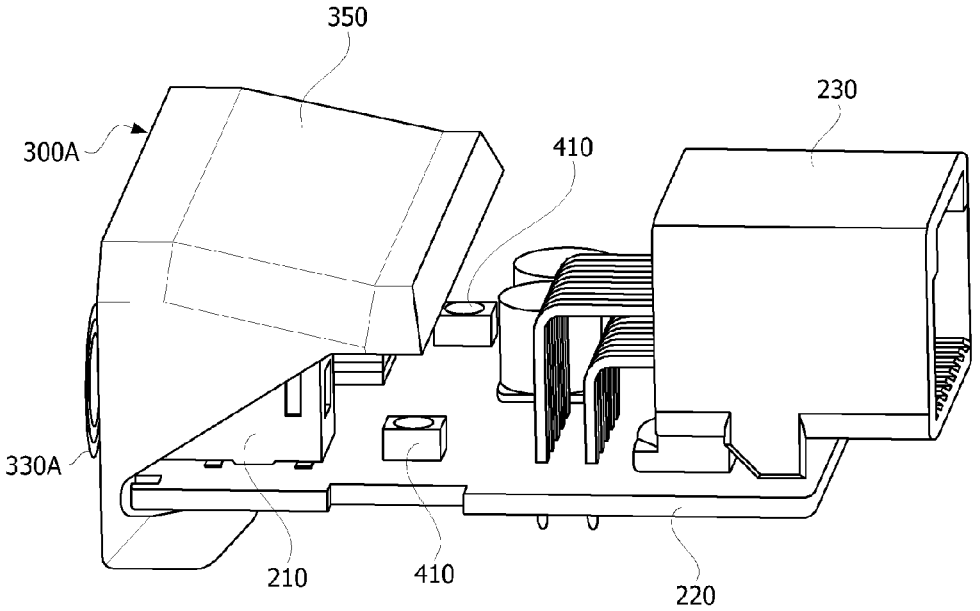
FIG. 11 is a perspective view showing an appearance of the terminal connection device when the terminal connection device of FIG. 10 is viewed from a right side.

FIG. 7 is a perspective view of a terminal connection device according to another embodiment of the present invention; FIG. 8 is a perspective view showing an appearance of the terminal connection device when the terminal connection device of FIG. 7 is viewed from a rear side; FIG. 9 is a right side view of the terminal connection device of FIG. 7; FIG. 10 is a perspective view showing an appearance of the terminal connection device resulting from inverting the terminal connection device of FIG. 7; and FIG. 11 is a perspective view showing an appearance of the terminal connection device when the terminal connection device of FIG. 10 is viewed from a right side.

Referring to FIGS. 7 to 11, the terminal connection device according to the present embodiment includes: a housing (not shown) having an inner space and an opening part; a terminal part having a printed circuit board located at an inner side of the housing, and a terminal 210 mounted to the printed circuit board; a housing cover 300A adopted to seal the opening part of the housing and to protect the terminal part; and an LED light source 410 mounted to the printed circuit board 220 and adopted to radiate light to the housing cover 300A.

The terminal connection device according to the present embodiment is similar to the terminal connection device, which has been previously described with reference to FIGS. 1 to 6, except for the fact that the housing cover 300A has a light guide part 350 of a guide prism, and the border lighting part 330A has a protruding structure. Accordingly, the same or similar elements refer to the same reference numerals, and the overlapping detailed description is omitted.

Explaining the elements of the terminal connection device and a connection relation among the elements in greater detail, first, the housing may have a shape or structure similar to that of the terminal housing. According to some embodiments, unlike the terminal housing, the housing may be configured to surround the terminal part and the light source other than the housing cover 300A. In addition, the housing may be omitted according to some embodiments. In this case, the front panel of the vehicle itself may replace the function of the housing. That is, the terminal connection device according to the present embodiment may be mounted to the front panel of the vehicle according to a structure of the front panel of the vehicle without a housing.

The terminal part includes: the terminal 210; the printed circuit board 220; and different kinds of PCB connectors 230. The terminal 210 includes an audio input terminal (AUX) and a USB terminal. The terminal 210, the printed circuit board 220 and the PCB connects 230 are substantially identical to the corresponding elements of the aforesaid embodiment.

The housing cover 300A includes: a terminal groove 310, the border lighting part 330A, and a light guide part 350. In the present embodiment, the housing cover 300A may be entirely structured to have predetermined light transmittance and to carry luminescence by light of the LED light source 410.

In addition, with regard to the housing cover 300A, the terminal groove 310 is an opening part located on a front surface 301 of the housing cover and adopted to expose one end of the terminal 210 to the outside. The terminal groove 310 may have a shape corresponding to the shape of a section of the terminal. In the present embodiment, two terminals 210, such as an audio input terminal and USB terminal, are exposed to the outside via the two terminal grooves 310. Furthermore, on the front surface 301 of the housing cover, titles of the terminals are indicated as 'AUX' and 'USB' in title indication areas corresponding to a lower portion of each terminal.

The border lighting part 330A is arranged on the housing cover 300A to face the edge of an end of the terminal 210 and protrudes from the front surface 301 of the housing cover to the outside. The border lighting part 330A protrudes from the front surface 301 of the housing cover at a predetermined height h1. When the border lighting part 330A protrudes at the predetermined height, the driver can easily accurately find and use a desired terminal with a touch without looking the terminal connection device even in the state where the driver fixes his or her eye on a front surface of the vehicle while driving.

Since the border lighting part may make a predetermined separation space between an external apparatus (an audio input device, a USB device, or the like) and the terminal 210, a height of the border lighting part 33A is set so that an electrical connection between the external apparatus and the terminal can be stably secured. For example, it is preferable that the height h1 of the border lighting part be 0 or more to about 3 mm or less. When the height is greater than 3 mm, a defective electrical connection between the terminal and the external apparatus may occur. In particular, the fault in the electrical connection between the external apparatus and the terminal generated in a shaking car may cause malfunction of the external apparatus. Thus, special care is required to secure a stable connection.

The light guide part 350 has a structure in which one end of the printed circuit board 220 presses a side of the light guide part in a lengthwise direction of the printed circuit board 220 so that the light guide part is compressed to the extent of a predetermined depth. This structure (for example, an opened shellfish-shaped structure) is intended to enable one end of the terminal 210 mounted to the printed circuit board to be easily exposed to the outside at the front surface 301 of the housing cover. Also, the structure is configured to effectively guide light, which is incident from a first LED light source 410 and at least one second LED light source 410 among the plurality of LED light sources mounted to the both surface of the printed circuit board, to the front surface of the housing cover, the first LED light source on the front surface of the printed circuit board 220 being arranged in an area to which the printed circuit board is mounted, and which faces the terminal 210, and the second LED light source on the rear surface of the printed circuit board being located at the rear (based on the front surface of the housing cover) of the terminal 210.

The light guide part 350 according to the present embodiment has an improved structure, namely, an integrated structure of the housing cover 300 and the light collecting part 420 that are previously described with reference to FIGS. 1 to 6. In detail, with regard to a length between the front surface and the rear surface of the light guide part 350, a length of the first light guide part located at an upper portion based on the printed circuit board is shorter than that of the second light guide part located at a lower portion. In addition, the light guide part 350 is configured to receive light emitted from two LED light sources 410 mounted on a first surface of the printed circuit board 220 and one LED light source 410 mounted to a second surface opposite to the first surface, and to uniformly radiate the light to the front surface 301 of the housing cover by bending a traveling direction of the light at least two times.

To do so, the light guide part 350 has a guide prism structure. The guide prism refers to a prism capable of guiding the refraction and concentration/dispersion of light in a desired direction. This guide prism may have a lens part or a rugged part for enabling the refraction and dispersion of light on at least one surface thereof. Since it is already known that the guide prism has been widely used in a backlight unit of an LED module, the detailed description thereof is omitted.

The LED light source 410 includes a plurality of LED modules. In order to realize high efficiency, it is desirable for the LED modules to use a product having a low forward voltage under the same forward current condition for the same kind of products. In addition the LED light source 410 is connected to a converter (not shown) for power supply mounted to the printed circuit board. In this case, the converter for power supply controls operation of three LED modules.

Figure 12:
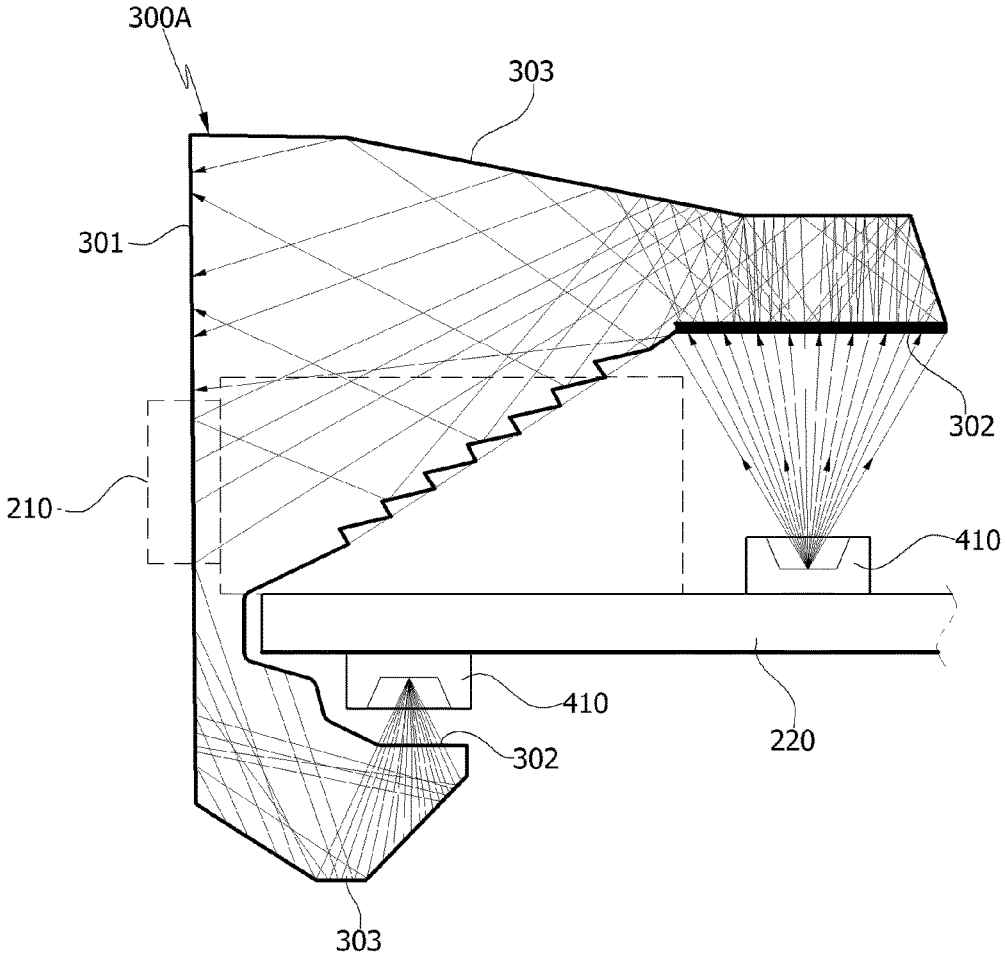
FIG. 12 is a schematically partial cross-sectional view for explaining an operational principle of a guide prism in a housing cover of the terminal connection device of FIGS. 7 to 11.

FIG. 12 is a schematically partial cross-sectional view for explaining an operational principle of a guide prism in a housing cover of the terminal connection device of FIGS. 7 to 11.

Referring to FIG. 12, as a light guide part, the guide prism used in the terminal connection device of the present embodiment is installed in the housing cover 300A. That is, when light is incident from the LED light sources 410 installed on each of the front surface and the rear surface of the printed circuit board 220, the light guide part (see reference numeral 350 of FIG. 11) formed with the guide prism functions to enable the light to be radiated to the front surface 301 of the housing cover at the inside of the housing cover 300A by refracting the incident light at least two times.

In this case, while the light emitted from the LED light sources 410 is incident from the outside of the housing cover 300A to one side (a rear portion of the housing cover, namely a portion facing the LED light sources), the light is primarily refracted at a predetermined angle according to a difference in refractive index generated from a boundary surface 302 and a size of an incidence angle. Then, the light straightly moves in the inside of the housing cover 300A and is reflected from an inner wall 303 of the housing cover 300A at least one time, and the light is secondarily refracted and is then radiated to the front surface of the housing cover.

According to the aforesaid embodiment, since the housing cover in which the guide prism is embedded is used, light of the plurality of LED light sources is effectively collected and dispersed so that the light can be uniformly transmitted to the front surface of the housing cover, and a shadow area generated from the front surface of the housing cover can be minimized. In addition, it is advantageous in that the light can be concentrated in a desired area or can be prevented from coming to undesired other areas, and the driver can easily use the terminal with a touch using the border lighting part even in various circumstances.

Figure 13:
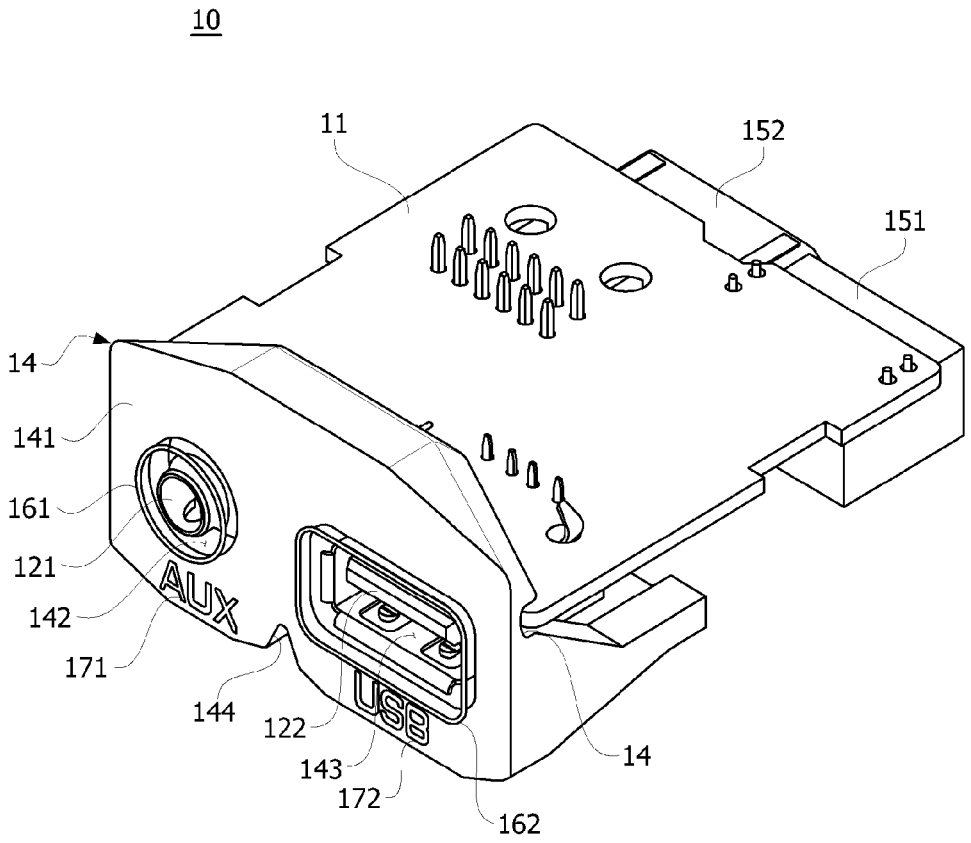
FIG. 13 is a perspective view showing an external terminal connection device according to a further embodiment of the present invention.
Figure 14:
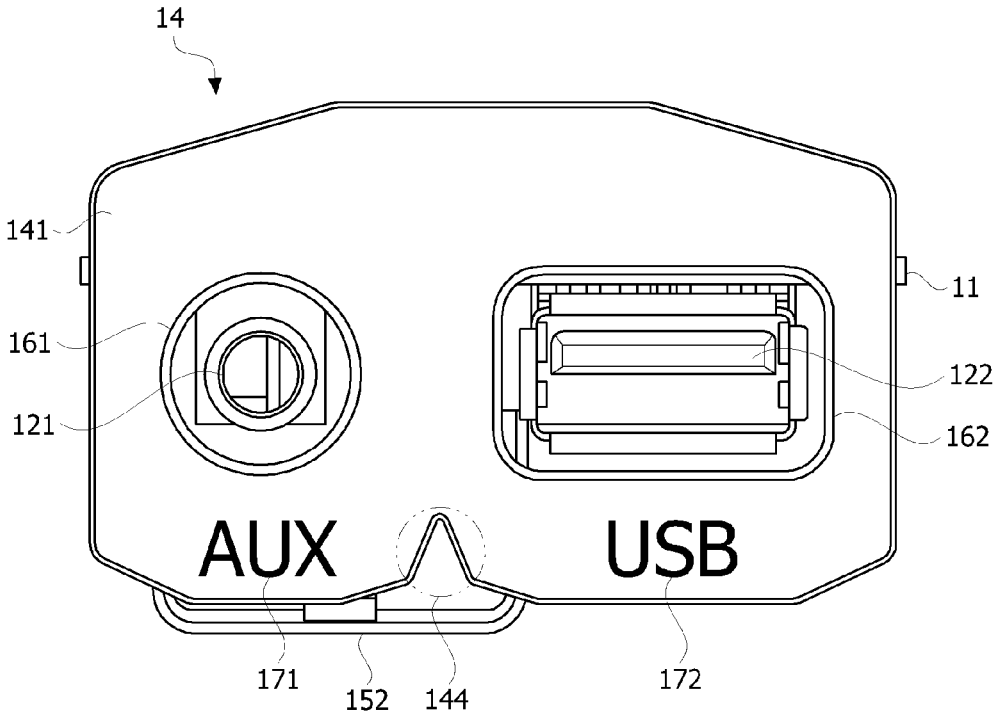
FIG. 14 is a front view showing the external terminal connection device of FIG. 13.
Figure 15:
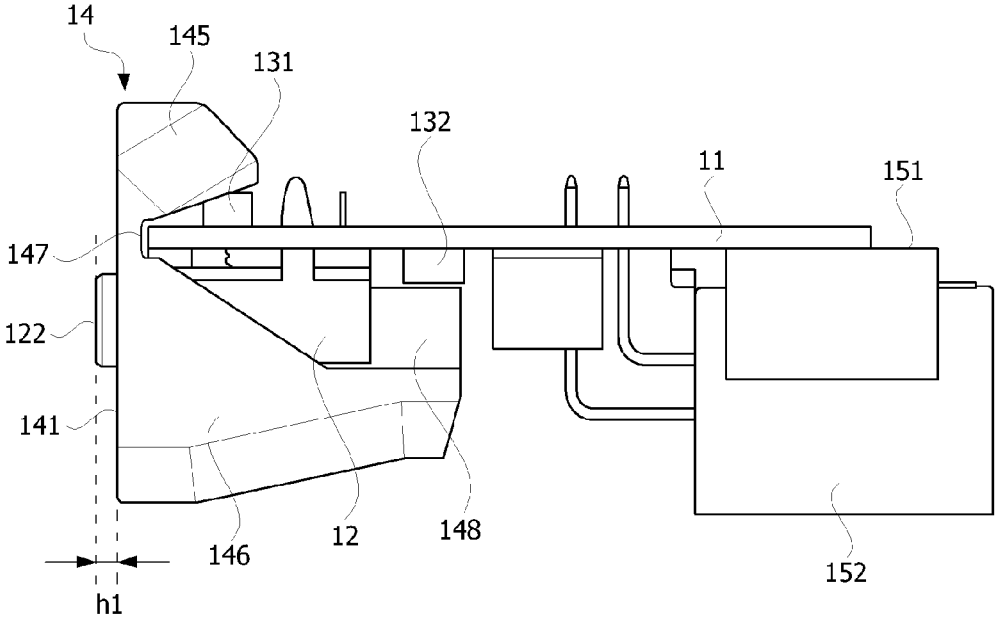
FIG. 15 is a perspective view showing an appearance of the external terminal connection device when the external terminal connection device of FIG. 13 is viewed from a right side.
Figure 16:
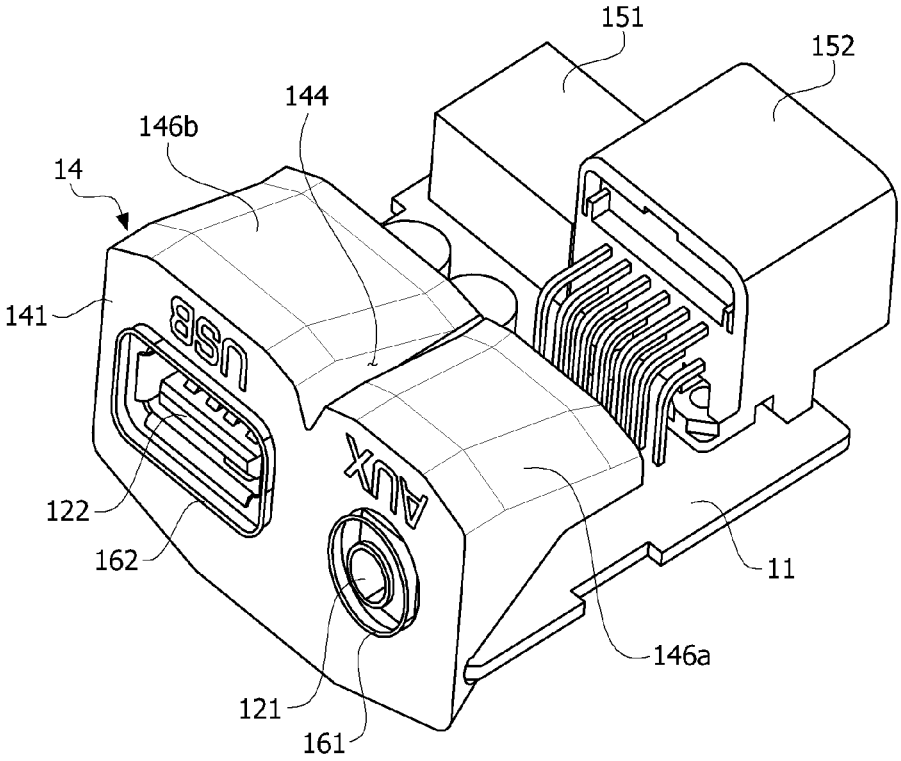
FIG. 16 is a perspective view showing an appearance of the external terminal connection device when the external terminal connection device of FIG. 13 is viewed from a rear side.
Figure 17:
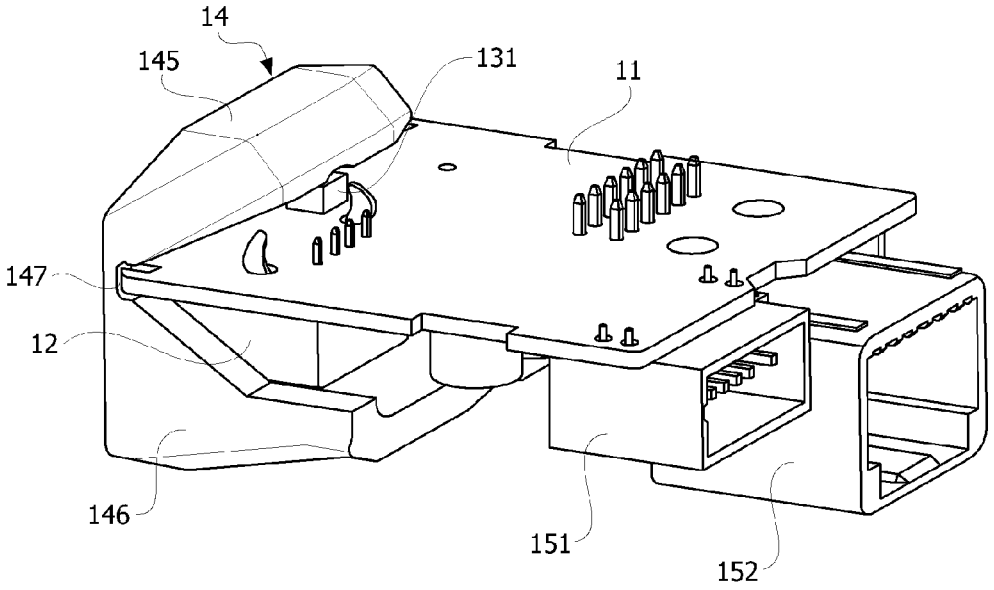
FIG. 17 is a perspective view showing an appearance of the external terminal connection device resulting from inverting the external terminal connection device of FIG. 13.
Figure 18:
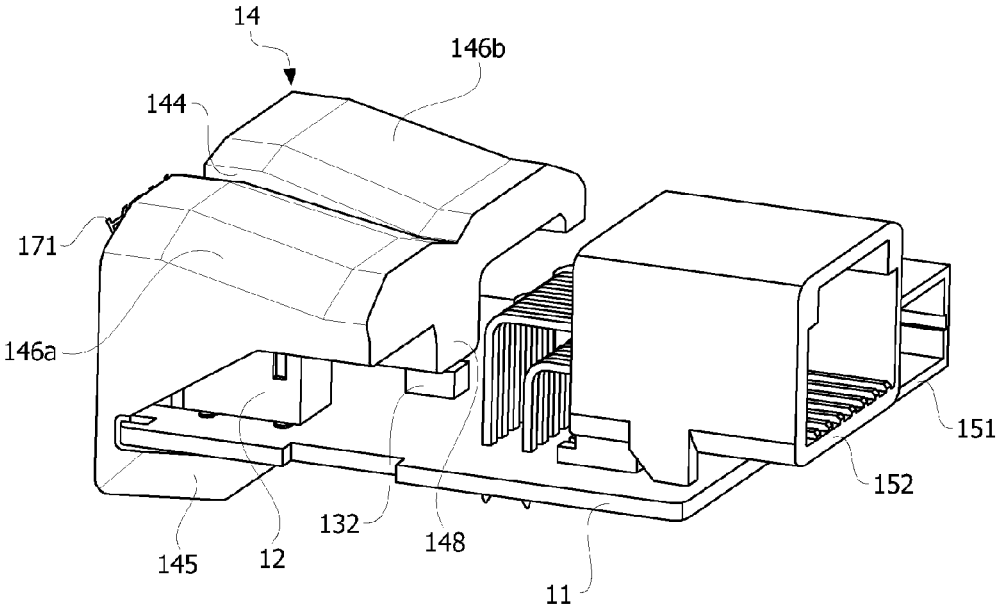
FIG. 18 is a perspective view showing an appearance of the external terminal connection device when the external terminal connection device of FIG. 17 is viewed from a rear side.

FIG. 13 is a perspective view showing an external terminal connection device according to a further embodiment of the present invention; FIG. 14 is a front view showing the external terminal connection device of FIG. 13; FIG. 15 is a perspective view showing an appearance of the external terminal connection device when the external terminal connection device of FIG. 13 is viewed from a right side; FIG. 16 is a perspective view showing an appearance of the external terminal connection device when the external terminal connection device of FIG. 13 is viewed from a rear side; FIG. 17 is a perspective view showing an appearance of the external terminal connection device resulting from inverting the external terminal connection device of FIG. 13; and FIG. 18 is a perspective view showing an appearance of the external terminal connection device when the external terminal connection device of FIG. 17 is viewed from a rear side.

Referring to FIGS. 13 to 18, the terminal connection device 10 according to the present embodiment includes: a printed circuit board 11; a plurality of terminals (121, 122) mounted to the printed circuit board; LED (Light-Emitting Diode) light sources 131, 132 mounted to the printed circuit board 11; and a housing cover 14. Therein, the housing cover 14 guides light of the second LED light source 132 by splitting the light into light of a first area and light of a second area, or guides light of the first and second LED light sources 131, 132 incident from the outside to one surface 141, to which the plurality of terminals 121, 122 are exposed, by refracting the light at least two times (see FIGS. 15 and 17). In order to distinguish the housing cover according to the present embodiment from the housing cover according to the aforesaid embodiment, the housing cover 14 according to the present embodiment may be referred to as a light guide-housing cover.

In addition, according to some embodiments, the terminal connection device 10 according to the present embodiment may further include a housing (not shown) that receives the printed circuit board 11, the plurality of terminals 12, the LED light sources 131, 132, the housing cover 14, PCB (Printed Circuit Board) connectors 151, 152, and the like. In this case, the housing may be configured such that one opening part of the housing engages with the housing cover 14, and another opening part enables the PCB connectors 151, 152 to be exposed to the outside. The plurality of terminals 12 may include a first terminal 121 and a second terminal 122.

In addition, according to some embodiments, the terminal connection device 10 according to the present embodiment may further include border lighting parts 161, 162 that protrude from one surface of the housing cover 14 to the outside and provide lighting to borders of the terminals 121, 122. The border lighting parts 161, 162 may be made of a predetermined light-impermeable material. In this case, the front surface of the housing cover 14 is made of a light-impermeable material. The light-impermeable material may be a material having light-impermeable property or a material resulting from coating the surface of a transparent material with a light-impermeable material.

In addition, the border lighting parts 161, 162 may protrude from one surface 141 of the housing cover to the extent of a predetermined height h1. The predetermined height h1 may be set within the range of 0 or more to about 3 mm so that a physical connection between a connection terminal and a terminal of the external apparatus inserted into the respective terminals 121, 122 is not interrupted. This height h1 may be set in a height that is identical to a protruding height of title indication parts 171, 172 in which titles of the terminals 121, 122 are indicated in a protruding structure.

Thanks to the border lighting part, the driver can rapidly accurately find the desired terminal through lighting indicated around the terminal even at night, and can also identify the desired terminal with a touch using a protruding height of the border lighting part.

Explaining the elements of the terminal connection device 10 in greater detail, first, the printed circuit board 11 includes a conductive pattern (not shown) arranged between the plurality of terminals 12 and the PCB connectors 15 and adopted to transmit an electrical signal (signal, power, or the like). In the present embodiment, the printed circuit board 11 may have a rectangular plate-like shape and may be inserted into and fixed to an inner concave part 147 of the housing cover 14. In this case, the plurality of terminals may be mounted to the opening parts 142, 143 of the front surface of the housing cover 15.

A converter (not shown) for power supply may be further mounted to the printed circuit board 11, the converter being mounted for supply power to the LED light sources 131, 132. In this case, the converter may be a means that appropriately converts battery power of the vehicle and supplies power to the LED light sources 131, 132, or a constitution part for performing a function corresponding to the means, and thus the converter may be mounted to the printed circuit board 11 as the means or the constitution part.

According to the aforesaid configuration, the printed circuit board 11 may supply power to the plurality of terminals 121, 122 and may function to facilitate direct communications with an external apparatus connected to the terminals 121, 122, or communications between the external apparatus and the vehicle control part through a predetermined interface.

In addition, according to some embodiments, the printed circuit board 11 may include a determination art (not show) adopted to determine the kind of the external apparatus connected to the terminals 121, 122, or to determine a connection state of the external apparatus. Furthermore, the printed circuit board 11 may further include a communication control part (not shown) controlling communications between the external apparatus and a vehicle control part, a signal conversion part (not shown) adopted to amplify or convert a signal, and the like.

The plurality of terminals 121, 122 may be connection terminals intended for connecting a terminal of the external apparatus to a vehicle battery or an electric apparatus system such as ECU (Electronic Control Unit) or the like, namely, the plurality of terminals may be audio input terminals (AUX) and USB (Universal Serial Bus) terminals. Therein, the external apparatus may be a smart phone, a PDA, a notebook computer, a camera, a camcorder, a navigation device, a battery charging device, a portable multimedia player, an MP3 player, and the like.

Of course, according to some embodiments, each of the plurality of terminals may be composed of different kinds of at least two audio input terminals or USB terminals, or a combination with other terminals (IEEE 1394 terminals or the like).

In the present embodiment, the plurality of terminals 121, 122 may be coupled to the housing cover 14 such that one end of each of the terminals 121, 122 is exposed via the two opening parts 142, 143 arranged on the front surface 141 of the housing cover 14.

The LED light sources 131, 132 may be implemented as LED elements that convert electrical energy into light. The LED light sources 131, 132 may be LED modules having at least one LED element, wherein the LED element may emit light having any one color of red, green, and blue, or may emit white color.

In the present embodiment, the LED light source includes a first LED light source 131 and a second LED light source 132. The first LED light source 131 and the second LED light source 132 are installed on a front surface and a rear surface of the printed circuit board 11, respectively, to radiate light to an upper portion and a lower portion of the front surface 141 of the housing cover based on the plurality of terminals 121, 122 by a coupling relation of the printed circuit board 11 and the housing cover 14.

In addition, the LED light source may be composed of a single first LED light source 131 arranged on the front surface of the printed circuit board 11, and a single second LED light source 132 arranged on the rear surface of the printed circuit board 11. As such, the LED light sources according to the present embodiment efficiently provide lighting using the two LED light sources via the housing cover 14 to which the plurality of terminals 121, 122 are mounted.

Explaining a connection relation between the LED light sources 131, 132 and the housing cover 14 in greater detail, mounting surfaces or light radiation directions of the first LED light source 131 and the second LED light source or a light radiation directions is roughly perpendicular to an extension direction of the front surface of the housing cover. This is intended to elongate the paths of light emitted from the LED light source 131 and the second LED light source 132, thereby radiating the light to the front surface 141 of the housing cover 14.

That is, since the LED light sources 131, 132 emit light in a point light source form, when the LED light sources 131, 132 emit light, the light is concentrated in a surface that is located at a distance close to each of the LED light sources. Accordingly, in the present embodiment, in order to substantially uniformly provide lighting all over the front surface 141 of the housing cover 14 that is located at a distance close to the LED light sources 131, 132 and has a relatively wide area, an arrangement structure of the LED light sources 131, 132 and the housing cover 14 are used, wherein the housing cover is arranged so that a surface to which light of the LED light sources is incident can roughly cross a surface to which light is introduced.

In addition, the housing cover 14 radiates light incident from the outside to the front surface of the housing cover by first, refracting the light, and by second, reflecting the light collided with an inner wall at least one time. To do so, the housing cover 14 has a guide prism structure. The guide prism is an element intended for reflecting light incident from the outside in the inside several times and for finally guiding the light to a predetermined surface. The guide prism structure applied to the present embodiment and the operational principle thereof will be hereinafter described in detail with reference to FIG. 19.

In addition, the housing cover 14 includes a light incoming part 148 protruding toward the second LED light source 132, and a barrier part 144 protruding inwardly from an inner wall of the housing cover 14, or from the inner wall to the light incoming part 148 (see FIG. 14).

The light incoming part 148 is a part that protrudes from one surface of the housing cover 14 to the second LED light source 132, and functions to concentrate light emitted from the second LED light source 132 at a short distance. Furthermore, the barrier part 144 guides beams collected by the light incoming part 148 to a first area 146*a* where one terminal (for example, an AUX terminal) is located, and a second area 146*b* where another terminal (for example, a USB terminal) is located.

This structure is intended to independently guide the light emitted from one second LED light source 132 to the two areas 146*a*, 146*b* to which the two terminals 121, 122 are mounted, and is useful to guide light emitted from a single light source to two areas.

The PCB connectors 15 are provided on one surface of the printed circuit board 11 and are connected to the power supply part of the vehicle and the vehicle control part. As the kind and structure of the PCB connectors 15, various socket forms for an electrical connection may be used.

Figure 19:
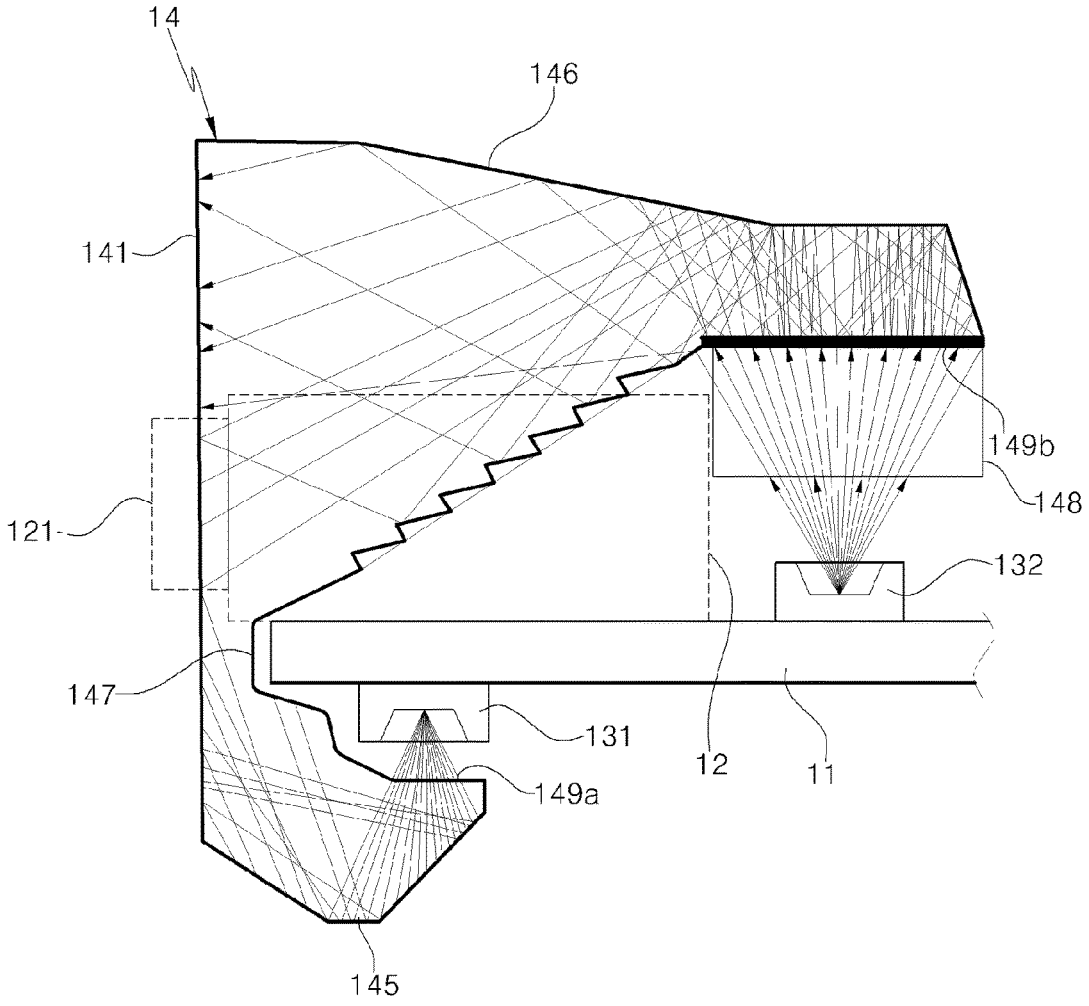
FIG. 19 is a schematically partial cross-sectional view for explaining an operational principle of a housing cover of the external terminal connection device of FIG. 13.

FIG. 19 is a schematically partial cross-sectional view for explaining an operational principle of a housing cover of the external terminal connection device of FIG. 13.

Referring to FIG. 19, the guide prism used in the terminal connection device according to the present embodiment is mounted in the housing cover 14. The housing cover 14 may be a guide prism itself, or may result from coating an external surface of the guide prism with a predetermined reflective material (metallic material or the like).

When light is incident from the LED light sources 131, 132 installed on the front surface and the rear surface of the printed circuit board 11, respectively to the inside of the housing cover 14, the housing cover 14 reflects the incident light in the inside thereof at least two times, thereby guiding the light to the front surface of the housing cover 14.

That is, the light emitting from the LED light sources 131, 132 is primarily refracted at an angle having a predetermined size according to a difference in refractive index between both mediums of incident surfaces while being incident from the outside of the housing cover 14 to the incident surfaces 149*a*, 149*b* of the housing cover, and the light is then reflected to the inner wall in the inside of the housing cover 14, and thereafter, is guided to the front surface 141 of the housing cover.

In particular, unlike the first LED light source 131 located on the front surface of the printed circuit board 11 and supplying light to the first area 145 located at the upper portion of the housing cover 14, the second LED light source 132 radiates light from the rear of the terminal part 12 to the inside of the housing cover 14 via the light incoming part 148 in order to efficiently provide illumination light to the two terminals 121, 122 on the front surface of the housing cover 14 located at the front of the terminal part 12. Therein, the housing cover 14 divides the light of the second LED light source 132 entered through the light incoming part 148 by the barrier part 144 into the light of the first area 146*a* and the second area 146*b* where the two terminals 121, 122 are located, thereby guiding the light.

According to the aforesaid embodiment, since the housing cover in which the guide prism is embedded is used, although a small number of LED light sources are used, the light can be effectively dispersed and collected. Thus, the light can be uniformly transmitted to the first and second areas 146*a*, 146*b* on the front surface of the housing cover, and occurrence of a shadow area of the front surface of the housing cover can be minimized. In addition, it is advantageous in that the light can be concentrated in a desired area or can be prevented from coming to undesired other areas, and the driver can easily use the terminal with a touch using the border lighting part even in various circumstances.

Meanwhile, according to the aforesaid embodiments, the opening parts 142, 142 of the front surface of the housing cover may correspond to terminal grooves 310. The printed circuit board 11 may be substantially identical to the printed circuit board 220 referred to with the different reference numeral, and the terminals 12, 121, 122 may be substantially identical to the terminal 210 referred to with the different reference numeral. Furthermore, the LED light sources 131, 132 may be substantially identical to the LED light source 410 referred to with the different reference numeral; the front surface 141 of the housing cover may be substantially identical to the front surface 301 referred to with the different reference numeral; and the PCB connectors 151, 152 may substantially identical to the PCB connector 230 referred to with the different reference numeral. Similarly, the border lighting parts 161, 162 may be also substantially identical to the border lighting part 330A referred to with the other reference numeral.

As previously described, in the detailed description of the invention, having described the detailed exemplary embodiments of the invention, it should be apparent that modifications and variations can be made by persons skilled without deviating from the spirit or scope of the invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims and their equivalents.

What is claimed is:

1. A terminal connection device, comprising:

a housing;

a printed circuit board located in the housing;

a terminal mounted to the printed circuit board;

a housing cover coupled to the housing and having a front surface that includes an opening that provides access to the terminal;

an LED light source mounted to the printed circuit board and configured to radiate light in a first direction; and a light guide cover that includes a light guide that receives light from the LED light source and internally redirects the light such that the light exits the light guide in a second direction to an interior surface of the light guide cover, wherein the interior surface redirects the light received from the light guide in a third direction to the front surface of the housing cover.

2. The terminal connection device of claim 1, wherein the light guide includes a guide prism.

3. The terminal connection device of claim 1, wherein the housing cover and the light guide cover are integrally connected.

4. The terminal connection device of claim 1, further comprising a connector mounted on the printed circuit board, wherein the connector is configured to provide at least one of a power connection or a data connection to the terminal connection device.

5. The terminal connection device of claim 1, wherein the interior surface includes a reflective coating.

6. The terminal connection device of claim 1, wherein the interior surface is polished.

7. The terminal connection device of claim 1, wherein the light guide cover further includes side walls having slots to receive the printed circuit board.

8. The terminal connection device of claim 1, wherein the LED light source includes a plurality of LED light sources mounted to a surface of the printed circuit board, and wherein the light guide redirects light provided by the plurality of LED light sources to the interior surface.

9. The terminal connection device of claim 1, further comprising a border lighting layer provided in the front surface of the housing cover, the border light layer transmitting light redirected by the interior surface to an exterior of the housing cover.

10. The terminal connection device of claim 9, wherein a protruding height of the border light part is between 0 to 3 mm.

11. The terminal connection device of claim 1, wherein the terminal is mounted on a first surface of the printed circuit board, wherein the LED light source includes a first LED light source mounted on the first surface of the printed circuit board, and a second LED light source mounted on a second surface of the printed circuit board, wherein the light guide includes a first light guide that receives and redirects light from the first LED light source and a second light guide that receives and redirects light from the second LED light source, and wherein the interior surface of the light guide cover includes a first interior surface to redirect light from the first light guide to the front surface and a second interior surface to redirect light from the second light guide to the front surface.

12. The terminal connection device of claim 11, wherein the light guide cover further includes first side portions and second side portion, wherein the first side portions combine with the top surface of the printed circuit board and the first interior surface to define a first interior space that covers the terminal and directs direct light from the first LED light source around the terminal and to the front surface, wherein the second side portions combine with the bottom surface of the printed circuit board and the second interior surface to define a second interior space that directs light from the second LED light source to the front surface, and wherein the first light guide is included in the first interior space, and the second light guide is included in the second interior space.

13. The terminal connection device of claim 12, wherein the first side portions have a relatively longer length than the second side portions.

14. The terminal connection device of claim 12, wherein the first light guide has a relatively longer length than the second light guide.

15. A terminal connection device, comprising:

a printed circuit board;

a plurality of terminals mounted to the printed circuit board;

an LED light source mounted to the printed circuit board; and a housing cover including:

a front surface with openings that provide access to the plurality of terminals, and a light guide that receives light from the LED light source in a first direction and internally redirects the light such that the light exits the light guide in a second direction to an interior surface of the housing cover, the interior surface of the housing cover redirecting the light from the light guide in a third direction to the front surface.

16. The terminal connection device of claim 15, wherein the light guide includes a guide prism that refracts the light radiated by the LED light source and reflects the light received from an inner wall of the housing cover to the front surface of the housing cover.

17. The terminal connection device of claim 15, wherein the plurality of terminals comprise at least one of an audio input terminal or a USB (Universal Serial Bus) terminal.

18. The terminal connection device of claim 15, wherein the terminal is mounted on a first surface of the printed circuit board, wherein the LED light source includes a first LED light source mounted on the first surface of the printed circuit board, and a second LED light source mounted on a second surface of the printed circuit board, and wherein the light guide includes a first light guide that redirects from the first LED light source around the terminal and to a first interior surface of the housing cover and a second light guide that redirects light from the second LED light source to a second interior surface of the housing cover.

19. The terminal connection device of claim 18, wherein the first surface and the second surface of the printed circuit board are perpendicular to a plane associated with the front surface of the housing cover.

20. A terminal connection device, comprising:

a printed circuit board;

a plurality of terminals mounted to the printed circuit board, the plurality of terminals including a first terminal and a second terminal;

an LED light source mounted to the printed circuit board, and a housing cover configured to guide light from the LED light source by dividing the light into light of a first area associated with the first terminal and light of a second area associated with the second terminal and to direct the light to a front surface that provides access to the plurality of terminals wherein the LED light source includes a first LED light source mounted on a upper surface of the printed circuit board and a second LED light source mounted on a lower surface of the printed circuit board, the first LED light source and the second LED light source being mounted in directions that are perpendicular to a plane associated with the front surface of the housing cover, the first LED light source radiating light received at an upper portion of the front surface and the second LED light source radiating light received at an upper portion of the front surface, and wherein the housing cover further includes an extension protruding toward one of the first or the second LED light sources, and a barrier protruding from an inner wall of the housing cover to the light incoming part.

* * * * *